US005081874A

United States Patent [19]

Isozumi

[11] Patent Number: 5,081,874

[45] Date of Patent: Jan. 21, 1992

[54] ENGINE STARTER

[75] Inventor: Shuzoo Isozumi, Himeji, Japan

[73] Assignee: Mitsubishi Denki Kabushiki Kaishi, Japan

[21] Appl. No.: 221,245

[22] PCT Filed: Oct. 1, 1987

[86] PCT No.: PCT/JP87/00729

§ 371 Date: Aug. 9, 1988

§ 102(e) Date: Aug. 9, 1988

[87] PCT Pub. No.: WO88/02567

PCT Pub. Date: Apr. 7, 1988

[30] Foreign Application Priority Data

Oct. 2, 1986 [JP] Japan ..... 61-236435

[51] Int. Cl.[5] ..... F02N 11/00

[52] U.S. Cl. ..... 74/7 A; 74/7 E; 290/48

[58] Field of Search ..... 74/7 A, 7 E, 6; 290/48, 290/38 C

[56] References Cited

U.S. PATENT DOCUMENTS

| | | | |
|---|---|---|---|
| 4,464,576 | 8/1984 | Williams | 290/38 C X |
| 4,507,978 | 4/1985 | Tanaka et al. | 74/7 E |
| 4,520,285 | 5/1985 | Isozumi et al. | 74/7 E X |
| 4,587,861 | 5/1986 | Morishita | 74/7 E |
| 4,604,907 | 8/1986 | Morishita et al. | 74/7 E |

FOREIGN PATENT DOCUMENTS

| | | | |
|---|---|---|---|
| 2448069 | 4/1976 | Fed. Rep. of Germany . | |
| 2624645 | 12/1977 | Fed. Rep. of Germany . | |
| 2624743 | 12/1977 | Fed. Rep. of Germany | 74/7 A |
| 2353721 | 6/1976 | France . | |
| 52-147712 | 12/1977 | Japan . | |
| 57-52773 | 11/1982 | Japan . | |
| 459150 | 5/1978 | Spain . | |
| 994887 | 6/1965 | United Kingdom . | |

*Primary Examiner*—Allan D. Herrmann
*Assistant Examiner*—Julie Krolikowski
*Attorney, Agent, or Firm*—Leydig, Voit & Mayer

[57] ABSTRACT

An engine starter is equipped with a motor having a cylindrical armature rotating shaft (3), a clutch mechanism (15) which transmits the rotational force of the motor, an output rotating shaft (17) which is disposed so as to mesh with the clutch mechanism (15) and be movable in the axial direction, and a solenoid switch (25) which has a moving member (32) which pushes the output rotating shaft (17) in the axial direction by electromagnetic force, the switch also causing a movable contact to contact a stationary contact and supply current to the motor. The output rotating shaft and the front portion of the moving body (32) of the solenoid switch (25) are both inserted into the cylindrical bore of the armature rotating shaft (3) from opposite ends, a sleeve bearing (23) is fit into the cylindrical bore and journals the output rotating shaft (17), whereby a cylindrical engine starter is obtained having a short overall length.

2 Claims, 3 Drawing Sheets

ENGINE STARTER

TECHNICAL FIELD

This invention relates to improvements in an engine starter for use in automobile engines and the like, and more particularly, it relates to an engine starter which houses a planetary reduction gear.

BACKGROUND ART

In the past, as one example of a starter of this type which housed a planetary reduction gear, there was the device shown in FIG. 1. In this figure, 100 is the armature of a direct current motor which is constituted by the following components. 101 is an armature core and 102 is an armature rotating shaft on the middle of which the armature core 101 is mounted. A commutator 103 fits on the rear portion of the armature 100. An armature coil 104 which is wound on the armature core 101 is connected to the commutator 103. 105 is brushes which are in contact with the commutator 103 and a holder which is connected to a rear bracket 107 by a bolt 106. 108 is a bearing which journals the rear end portion of the armature rotating shaft 102 and which is inserted into a recess in the rear bracket 107. 109 is a yoke of the direct current motor. A plurality of permanent magnets 109*a* which generate a magnetic field in the armature 100 are secured to its inner peripheral surface. A front bracket 111 in which is fit an internal gear 110 which constitutes a planetary reduction gear is mounted on the end surface of the yoke 109 as shown in the figure. A spur gear 112 is formed on the front end of the armature rotating shaft 102. Both it and the internal gear 110 mesh with a plurality of planetary gears 113. 114 indicates bearings which are mounted on the inner peripheral surfaces of the planetary gears 113 and which are journalled on supports pins 115. 116 is a flange to which the support pins 115 are secured. It constitutes an arm of the planetary reduction gear and is secured to an output rotating shaft 117. 118 is a sleeve bearing which fits into the inner periphery of a protrusion of the internal gear 110 and which journals the output rotating shaft 117. 119 is a sleeve bearing which fits into a recess in the rear portion of the output rotating shaft 117 and which journals the front end of the armature rotating shaft 102. 120 is a steel ball which is disposed between the ends of the armature rotating shaft 102 and the output rotating shaft 117 and which has the function of bearing thrusts.

121 indicates helical splines which are formed on the outside of the midportion of the output rotating shaft 117. An overrunning clutch 122 engages therewith so as to be able to slide back and forth. 123 is a stopper which is disposed on the front end of the output rotating shaft 117 and which restricts the axial movement of a pinion 124 which is connected to the overrunning clutch 122. 125 is a sleeve bearing which is mounted on the inner surface of the front end of the front bracket 111 and which journals the front end of the output rotating shaft 117. 126 is a molded resin-based plastic lever which has a rotating shaft 126*a* at its midportion. As shown in the drawing, one end is connected to a plunger 128 of a solenoid switch 127 and the other end fits around the outside of the overrunning clutch 122. 129 is a movable contact which is mounted on a rod 131 through an electrically insulating member 130, the rod 131 being inserted into a core 132 and being slidable back and forth therein. 133 is a stationary contact which is secured to an electrically insulating member in the form of a cap 135 by a nut 134. 136 is an exciting coil which activates the plunger 128. It is wound around a molded plastic bobbin 137 and is housed inside a case 138. 139 is a lead wire which is connected to the stationary contact 133 and to the brushes of the brushes and holder 105.

Next, the operation will be explained. When an unillustrated starter switch is closed to cause current to flow through the exciting coil 136 of the solenoid switch 127, the plunger 128 is activated and moves backwards, pushing the rod 131 backwards and making the movable contact 129 and the stationary contact 133 contact one another. As a result, current is supplied from the stationary contact 133 to the armature 100 by the brushes and holder 105 via the lead wire 139, and the armature 100 generates rotational force. The rotation of the armature 100 is transmitted from the spur gear 112 to the planetary gears 113, and the rotation is transmitted to the overrunning clutch 122 while being reduced in speed by the planetary reduction gear. At this time, the pinion 124 which engages with the overrunning clutch 122 is made to rotate.

On the other hand, the force of the plunger 128 which is activated in the above manner causes the lever 126 to rotate in the counterclockwise direction about the rotating shaft 126*a* and slide the overrunning clutch 122 and the pinion 124 forward in the axial direction. As a result, the pinion 124 is brought into engagement with a ring gear which is secured to a flywheel which is mounted on the crankshaft of an unillustrated engine.

After the engine is started, the overrunning clutch 122 separated from the pinion 124 due to the rotation of the engine with respect to the pinion 124, and the pinion 124 will perform idle rotation.

As a conventional engine starter is constructed in the above-described manner, the solenoid switch and the direct current motor have their shafts arranged in parallel, so when the starter is mounted on an engine, it is necessary to ensure space for the solenoid switch in either the engine or in the portion of the side of the vehicle into which the engine fits. This creates problems such as restrictions on the engine layout in the vehicle. In addition, there was the problem that in order to avoid interference between the front end of the front bracket and a member such as a flywheel within the engine transmission housing, the shape of the flywheel was limited.

This invention was made in order to solve the above-described problems, and its object is to provide an engine starter in which a solenoid switch and a motor can be coaxially disposed, in which the bearing for the output rotating shaft is cantilevered as seen from the pinion, and which is easy to mount on an engine.

DISCLOSURE OF THE INVENTION

An engine starter in accordance with this invention is of the type comprising an electric motor having a cylindrical armature rotating shaft, an output rotating shaft which is disposed at one axial end of the motor, which is disposed in an axially aligned relationship with respect to the armature rotating shaft, and which is supported so as to be able to slide in the axial direction, a clutch mechanism for transmitting the rotational force of the armature rotating shaft to the output rotating shaft, and a solenoid switch which has a moving member which is disposed on the other axial end of the motor and pushes and slides the output rotating shaft by electromagnetic force, the solenoid switch also supplying current to the motor by forcing a movable contact and a stationary contact to contact one another by the above-mentioned electromagnetic force, characterized in that the axes of all of the above members are aligned, a sleeve bearing is fit into the cylindrical bore of the armature rotating shaft, and the rear portion of the output rotating shaft is journalled by the sleeve bearing.

With such an arrangement, both linear and rotational movement of the output rotating shaft are possible, and the extension of the overall length which accompanies axial alignment can be decreased.

BEST MODE FOR CARRYING OUT THE INVENTION

In order to explain the present invention in greater detail, it will hereinbelow be explained based on the drawings.

Figure 1:
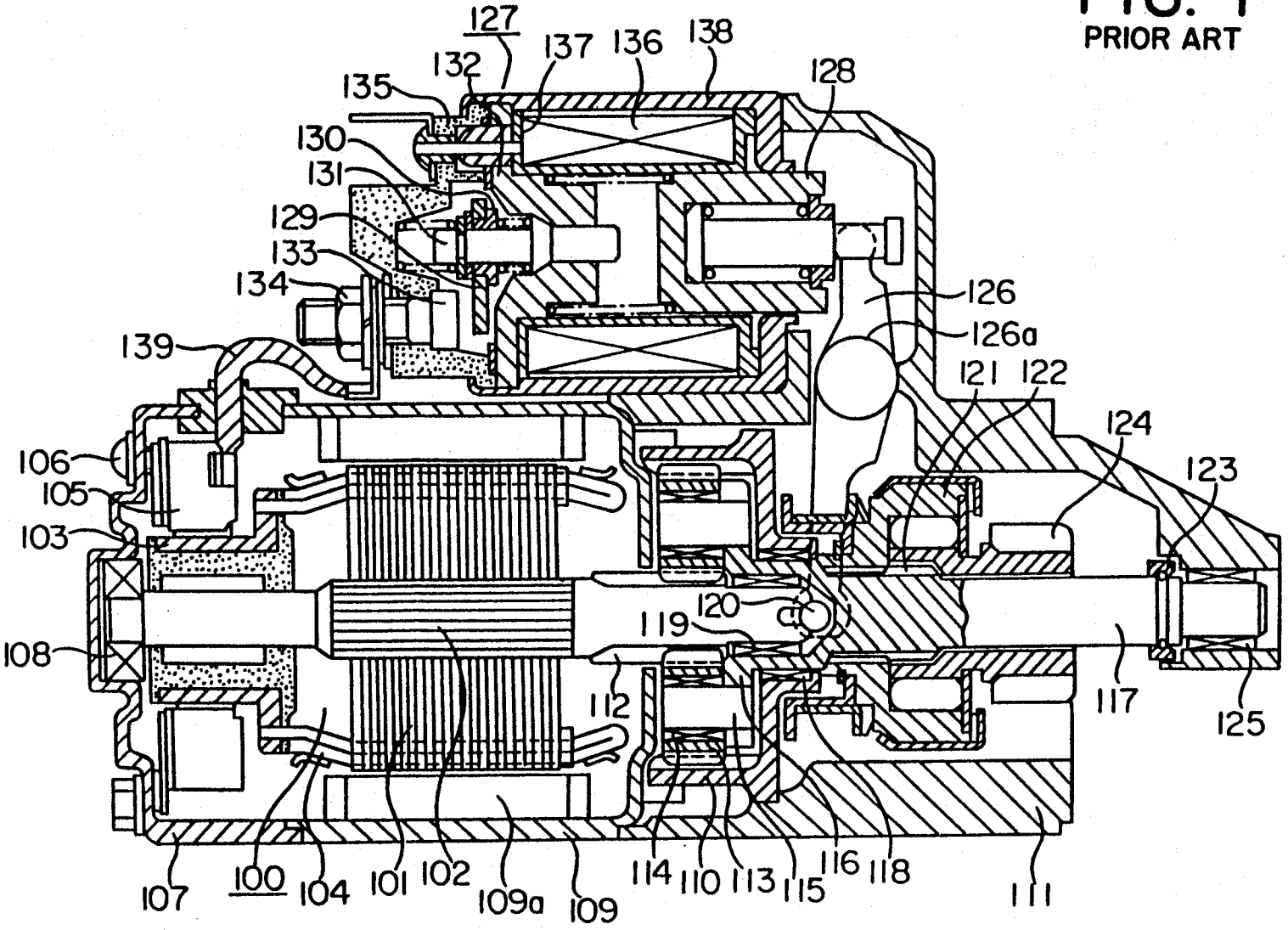
FIG. 1 PRIOR ART
FIG. 1 is a cross-sectional view of an example of a conventional engine starter.
Figure 2:
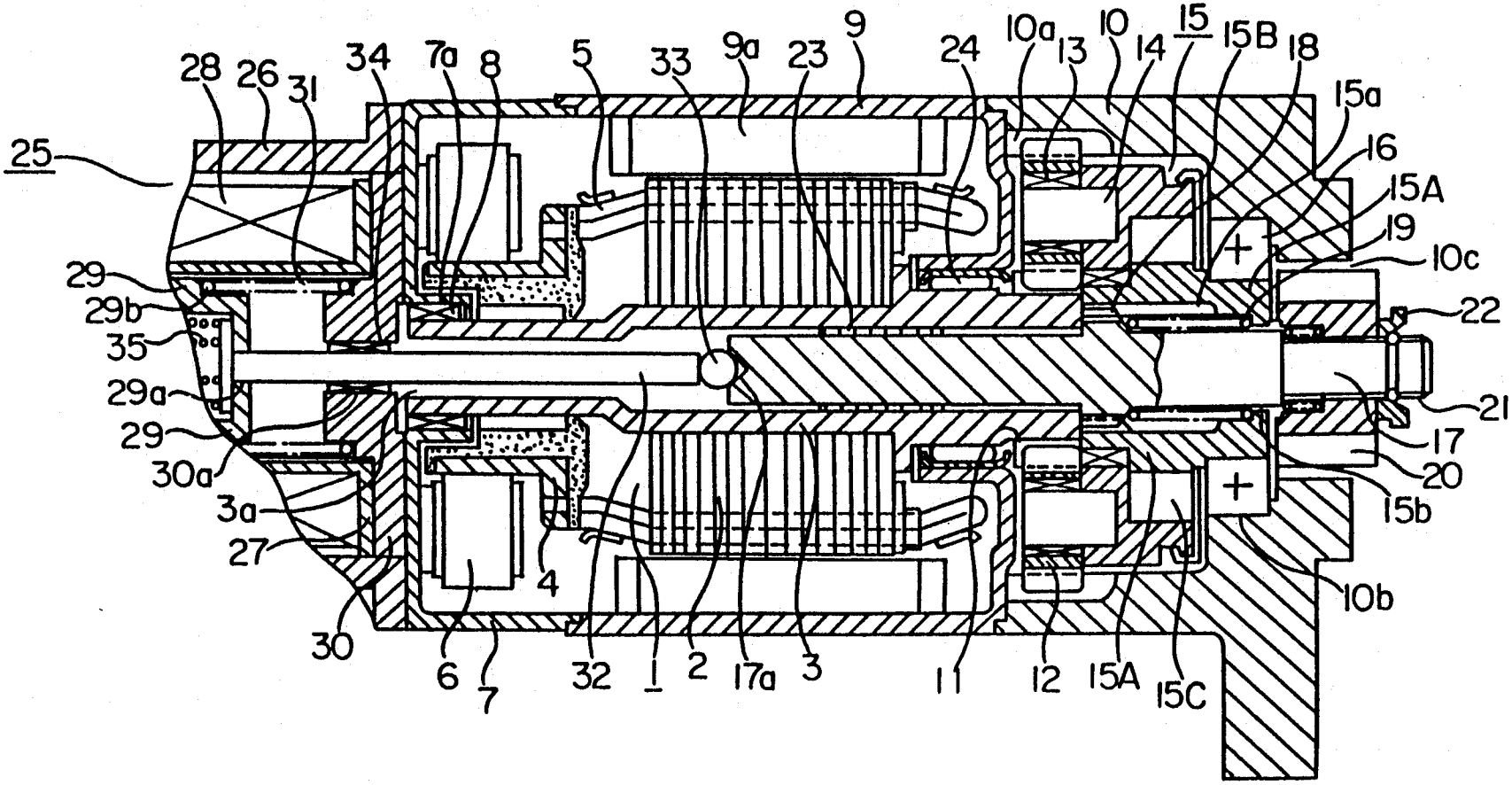
FIG. 2 is a cross-sectional view of a portion of one embodiment of an engine starter in accordance with this invention.

FIG. 2 is a cross-sectional view of a portion of one embodiment of the engine starter of the present invention.

With respect to FIG. 2, "front" refers to the right side of the relevant components, and "rear" indicates the left side. 1 is the armature of a direct current motor which is composed of the following elements. 2 is an armature core, 3 is a cylindrical armature rotating shaft on the midportion of which the armature core 2 is mounted, the shaft having a cylindrical bore 3*a*. A commutator 4 fits onto the rear portion of the shaft. The commutator 4 is connected to an armature coil 5 which is wound around the armature core 2.

6 is brushes and a holder which are disposed on the outside of the commutator 4 so as to be in contact therewith, and 7 is the rear bracket of the direct current motor to the inner side of the rear end of which the brushes and holder 6 are connected by an illustrated bolt. The center of the rear end thereof is bent inwards and forwards so as to form a bearing hole 7*a* which extends in the forwards and backwards direction, which is the axial direction of the rotational axis. 8 is a bearing which journals the rear end of the armature rotating shaft 3 and which fits into the bearing hole 7*a*. 9 is the yoke of the direct current motor; its rear end surface is joined to the front end surface of the rear bracket 7. A plurality of permanent magnets 9*a* which form a magnetic field in the armature 1 are secured to its inner surface. The step-shaped rear rim of a front bracket 10 which has an internal gear 10*a* which constitutes a portion of a planetary gear train is mounted on the step-shaped outer rim on the front end surface of the yoke as shown in the figure.

The front bracket 10 has a plurality of recesses formed therein whose inner diameters decrease in a step-wise manner from the rear towards the front. It has an internal gear 10*a* formed on the inner peripheral surface of its rear portion, a bearing recesses 10*b* formed on the inside of its midportion, and a small-diameter hole 10*c* formed in its front portion. 11 is a spur gear which is formed on the outside of the front end of the armature rotating shaft 3 and which serves as a sun gear, and 12 indicates planetary gears which are disposed between and mesh with the spur gear 11 and the internal gear 10*a*. 13 indicates bearings which fit inside the planetary gears 12, 14 indicates support pins which support the bearings 13, and 15 is an overrunning clutch having a conventional overrunning clutch mechanism. It comprises an overrunning clutch inner member 15A having helical splines 15*a* which are formed on its inner surface near the axis and an inwards protrusion 15*b* which is forward of the splines and has an inner diameter which is smaller than the inner diameter of the splines, an overrunning clutch outer member 15B which can engage with and disengage from the inner member and which has the support pins 14 secured to its rear portion, and rollers 15C which are disposed between the overrunning clutch inner member 15A and the overrunning clutch outer member 15B. 16 is a bearing which fits over the overrunning clutch inner member 15A and carries radial loads and which fits into the recess 10*b* in the front bracket 10. 17 is an output rotating shaft which has a recess 17*a* in its rear end surface. Teeth 18 for engaging splines which have a larger diameter than the inner diameter of the opening at the front end of the armature rotating shaft 3 are formed on its midportion. These teeth engage with the helical splines 15*a* so as to be able to slide backwards and forwards. 19 is a spring which is disposed closer to the rotational axis than the roots of the teeth 18 between the front surfaces thereof and the rear end of the inwards protrusion 15*b*. It always biases the output rotating shaft 17 backwards. 20 is a pinion which engages with straight splines 21 which are formed on the front end of the output rotating shaft 17. 22 is a stopper which is disposed on the front end of the output rotating shaft 17 and which causes the pinion 20, which is biased in the forward direction by the spring which is disposed between the recess at the rear of the pinion 20 and the step in the output rotating shaft 17, to engage with the output rotating shaft 17.

23 is a sleeve bearing which fits into the cylindrical bore 3*a* of the armature rotating shaft 3. It journals the rear portion of the output rotating shaft 17 which is inserted into the cylindrical bore 3*a* from its front end and makes it possible for the output rotating shaft 17 to perform both linear and rotational movement. 24 is a bearing which fits into the bearing hole in the midportion of the front end of the yoke 9 and which journals the armature rotating shaft 3 between the installation portion for the armature core 2 and the spur gear 11.

25 is a solenoid switch which is directly connected to the rear portion of the direct current motor which has the armature 1 and which is for the purpose of applying a thrust to the output rotating shaft 17 when it is energized. It comprises the following elements. 26 is a case which has an opening in its front end and which is rigidly held in place with its front end abutting against the rear end of the rear bracket 7. 27 is a bobbin which is housed within the case and which has a recess for coils which extends forwards and backwards. 28 is an exciting coil which is wrapped around the bobbin 27. 29 is a plunger which is housed in the central hole of the bobbin 27 and is able to move back and forth and is made from a strongly magnetic member. Its center is hollow and it has a hole 29*a* which extends from the front end of its hollow inside to the outside. The front edge is in the form of a step 29*b*. 30 is a core which fits into the opening of the case 26, which has a step to which the bobbin 27 is secured, and which has a bearing hole 30*a* at its center. 31 is a return spring which is disposed between the support member 30 and the step 29*a* and which biases the plunger 29 rearwards. 32 is a plunger rod having a T-shaped longitudinal cross section. Its front portion is inserted into the cylindrical bore 3*a* from the rear opening of the armature rotating shaft 3. It is aligned with the recess 17*a* in the rear end of the output rotating shaft 17 and is separated therefrom by a steel ball 33. Its midportion is journalled by a bearing 34 which fits into the bearing hole 30*a*. Its rear end extends through hole 29*a* and is disposed in the hollow portion of the plunger 29, and it is biased forwards and connected to the plunger 29 by a spring 35 which is disposed in the rear of the hollow portion.

Figure 3:
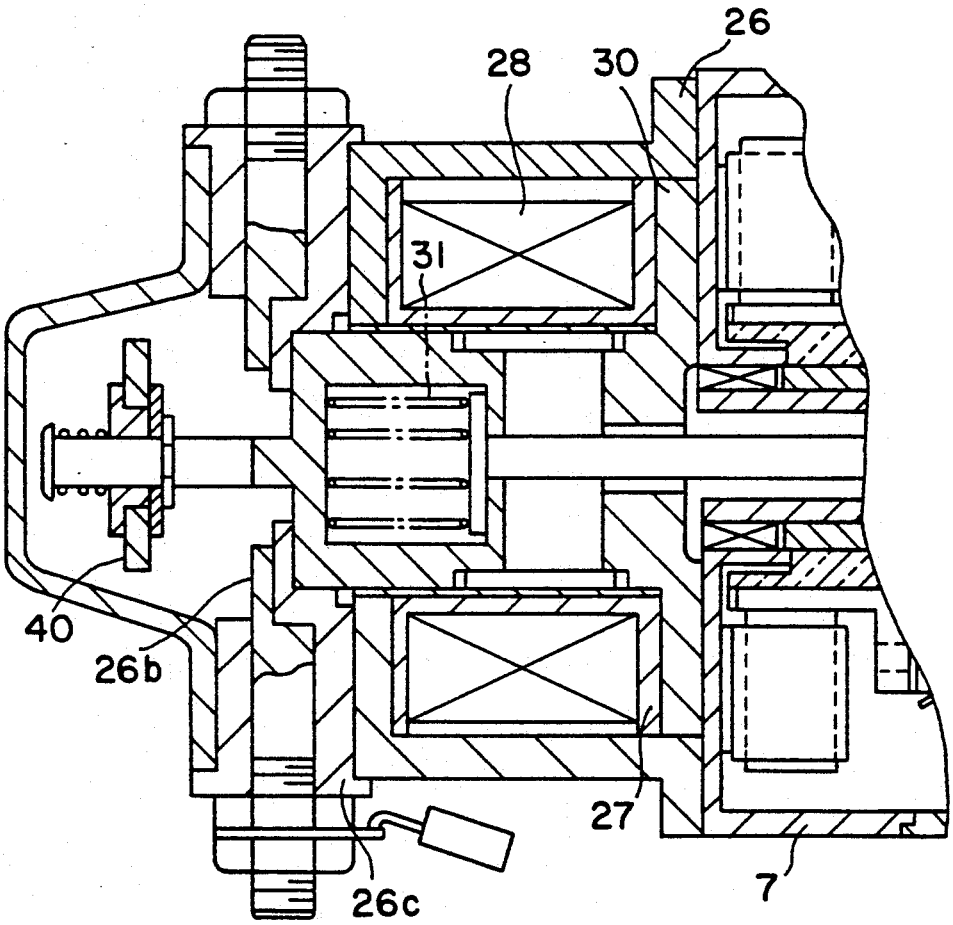
FIG. 3 is a cross-sectional view of the left hand portion of the starter of FIG. 2, and shows a movable contact and a stationary contact.

FIG. 3 corresponds to the left hand portion of the engine starter of FIG. 2. A movable contact 40 is installed on the rear of the plunger 29 through insulating member, and a stationary contact 26*b* is installed on the rear of the case 26 through an electrically insulating member 26*c* in a position such that it confronts the movable contact from the front. The movable contact is connect to the (+) terminal of a direct current power supply by an unillustrated lead wire, it is grounded on the (−) side of the brushes and holder 6, and the remaining (+) side is connected to the stationary contact by an unillustrated lead wire. Furthermore, the exciting coil 28 is connected to the direct current power supply through an unillustrated starter switch.

Next, the operation of this embodiment of the present invention will be explained. When the unillustrated starter switch is in an open state, the exciting coil 28 is unexcited, so the only force acting on the plunger 29 is the force of spring 31, and the plunger 29 and the plunger rod 32 are disposed in their rearmost position. As a result, the output rotating shaft 17 does not receive a thrust from the solenoid switch 25, it is biased backwards by spring 19, and it is positioned backwards until the front end surface of the armature rotating shaft 3 and the rear surface of the teeth 18 abut, as shown in the drawing. Furthermore, the front end of the plunger rod 32 of the solenoid switch 25 contacts the steel ball 33 so that the steel ball 33 does not come out of the recess 17*a* in the output rotating shaft 17. Of course, at this time, no current passes through the armature 1 and it is stopped.

If the above-mentioned starter switch is then closed, current is passed through the exciting coil 28 of the solenoid switch 25, and the plunger is activated and moved forwards by the electromagnetic force which is generated by the excitation. The forward movement of the plunger 29 causes the unillustrated movable contact to contact the unillustrated stationary contact, causing current to flow through the brushes and holder 6 which are connected to the stationary contact. This current flows through the armature coil 5 via the commutator 4 and also flows through the grounded brushes and holder 6 and flows to ground. As a result of supplying current to the armature 1 in this manner, the armature 1 generates a rotational force. The rotational force of the armature 1 is transmitted to the planetary gears 12 from the spur gear 11, causing the planetary gears 12 to revolve and transmit a revolving force to the overrunning clutch 15. As the overrunning clutch 15 is engaged due to the action of the rollers 15*c*, the revolving force which is transmitted to the overrunning clutch 15 is transmitted from the helical splines 15*a* to the teeth 18 with which the splines are engaged. As a result, the output rotating shaft 17 rotates integrally with the pinion 20 at a slower rate than the armature 1.

On the other hand, the force of the plunger 29 which is urged forwards pushes the plunger rod 32 through spring 35 and moves it forwards. Therefore, the output rotating shaft 17 receives a forward thrust from the plunger rod 32 through the steel ball 33, and this thrust moves it forwards together with the pinion 20 against the force of spring 19. At this time, the teeth 18 move forwards while engaging with the splines 15*a* and their position of engagement changes. Due to the forwards movement of the output rotating shaft 17, the pinion 20 which protrudes forwards through the small-diameter hole 10*c* meshes with a ring gear on the outer periphery of a flywheel which is mounted on the engine. Therefore, the rotational force of the armature 1 is transmitted to the ring gear by the pinion mechanism at a reduced speed, and the engine is started.

Immediately after the engine has started, the rotational force of the engine is transmitted to the pinion 20 through the ring gear. Therefore, the rotational speed of the pinion 20 and the output rotating shaft 17 increases. Due to the action of the rollers 15*c* caused by this rotation, the overrunning clutch 15 disengages, and the pinion 20, the output rotating shaft 17, and the like rotate idly.

Furthermore, after the starting of the engine, when the starter switch is opened, the output rotating shaft 17 no longer receives a thrust from the solenoid switch 25 and is returned to its illustrated position by the restoring force of the energizing spring 19, and the starter returns to its initial state (the illustrated state).

In the above-described embodiment, the case was explained in which the sun gear 11 was formed on the armature rotating shaft 3. However, the sun gear may be made to engage with the armature rotating shaft by means of splines or the like. In addition, in the above-described embodiment, the case was explained in which the magnetic field of the direct current motor was generated by permanent magnets 9*a*, but the same effects as with the above-described embodiment can be obtained if a coil is wound around a magnetic pole core.

Furthermore, in the above-described embodiment, the case was explained in which the internal gear 10*a* was formed on the end of the front bracket 10. However, an internal gear which is a distinct member may be fitted into the inside of the front bracket.

In the above manner, in accordance with the present invention, the armature rotating shaft of a motor, an output rotating shaft which receives starting rotational force from the motor and outputs rotational force, and a solenoid switch which imparts a thrust to the output rotating shaft are axially aligned, the armature rotating shaft of the motor is made cylindrical in shape, the output rotating shaft and the end rod portion of a moving portion of the solenoid switch are both inserted into the cylinder from opposite ends, a sleeve bearing is fit into the cylinder and journals the output rotating shaft. Therefore, there are the effects that a structure is obtained which has a short overall length and which is short in the direction perpendicular to the axial direction, the ease of mounting on a vehicle is excellent, and there are no restrictions on engine layout.

I claim:

1. An engine starter comprising:

an electric motor having a cylindrical armature rotating shaft, an output rotating shaft, the armature shaft having a cylindrical bore concentric with the axis of the armature shaft, said output rotating shaft being armature shaft, an output slidably received in the bore and extending into the bore at one axial end of said motor, a one-way clutch mechanism transmitting rotational force of said armature rotating shaft to said output rotating shaft when said motor is operated, and a solenoid switch which has a moving member extending into the bore at the other axial end of said motor which pushes and slides said output rotating shaft by electromagnetic force, said solenoid switch also having a movable contact and a fixed contact for supplying current to said motor by forcing the movable contact into contact with the stationary contact by said electromagnetic force, and said output rotating shaft being journalled in the cylindrical bore of said armature rotation shaft.

2. An engine starter as claimed in claim 1, wherein the diameter of teeth formed on the outer peripheral surface at the midportion of said output rotating shaft which engage with splines on the inner peripheral surface of said clutch mechanism have a diameter larger than the diameter of the cylindrical bore of said armature rotating shaft.

* * * * *

UNITED STATES PATENT AND TRADEMARK OFFICE

CERTIFICATE OF CORRECTION

PATENT NO. : 5,081,874

DATED : JANUARY 21, 1992

INVENTOR(S) : SHUZOO ISOZUMI

It is certified that error appears in the above-identified patent and that said Letters Patent is hereby corrected as shown below:

Claim 1, Column 7, Line 2, delete "armature shaft, an output".

Signed and Sealed this

Eleventh Day of May, 1993

*Attest:*

Michael K. Kirk

MICHAEL K. KIRK

*Attesting Officer*

*Acting Commissioner of Patents and Trademarks*